US011724902B2

(12) United States Patent
Hiruma

(10) Patent No.: US 11,724,902 B2
(45) Date of Patent: Aug. 15, 2023

(54) PRINTING APPARATUS

(71) Applicant: Seiko Epson Corporation, Tokyo (JP)

(72) Inventor: Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/654,483

(22) Filed: Mar. 11, 2022

(65) Prior Publication Data

US 2022/0288956 A1 Sep. 15, 2022

(30) Foreign Application Priority Data

Mar. 12, 2021 (JP) ..... 2021-040004

(51) Int. Cl.

| | |
|---|---|
| ***B65H 19/12*** | (2006.01) |
| ***B41J 15/04*** | (2006.01) |
| ***B65H 19/30*** | (2006.01) |
| ***B65H 18/02*** | (2006.01) |
| *B65H 18/10* | (2006.01) |

(52) U.S. Cl.

CPC ..... *B65H 19/126* (2013.01); *B41J 15/04* (2013.01); *B41J 15/042* (2013.01); *B65H 18/02* (2013.01); *B65H 19/30* (2013.01); *B65H 18/103* (2013.01); *B65H 2405/42* (2013.01); *B65H 2405/422* (2013.01)

(58) Field of Classification Search

CPC .... B65H 18/02; B65H 18/103; B65H 19/126; B65H 19/30; B65H 2405/42; B65H 2405/422; B41J 15/02; B41J 15/04; B41J 15/042

See application file for complete search history.

(56) References Cited

U.S. PATENT DOCUMENTS

| | | | | |
|---|---|---|---|---|
| 5,052,877 | A * | 10/1991 | Jaaskelainen | B65H 49/38 414/458 |
| 5,378,104 | A * | 1/1995 | Payne, Jr. | B65H 19/126 242/598.5 |
| 10,239,334 | B2 * | 3/2019 | Torigoe | B41J 15/04 |
| 2009/0104007 | A1 * | 4/2009 | Umezawa | B66F 9/063 414/349 |
| 2012/0205418 | A1 | 8/2012 | Horie et al. | |

FOREIGN PATENT DOCUMENTS

| | | |
|---|---|---|
| JP | 2012-166914 | 9/2012 |
| JP | 2015-020400 | 2/2015 |

* cited by examiner

*Primary Examiner* — Jill E Culler
(74) *Attorney, Agent, or Firm* — Workman Nydegger

(57) ABSTRACT

Provided is a printing apparatus including: a holder unit provided with a holding member, a contact portion, and a shaft member, and an apparatus body provided with a support portion, and a fixing portion, wherein the shaft member is configured to be detachably attached to the support portion, the holder unit is configured to be rotatable between a first position and a second position with reference to the shaft member in a state where the shaft member is supported on the support portion, the first position is a position where the shaft member is attached to the support portion, and the second position is a position where the apparatus body fixes the holder unit by the fixing portion, the second position being a position where the contact portion is separated from the installation surface.

7 Claims, 6 Drawing Sheets

PRINTING APPARATUS

The present application is based on, and claims priority from JP Application Serial Number 2021-040004, filed Mar. 12, 2021, the disclosure of which is hereby incorporated by reference herein in its entirety.

BACKGROUND

1. Technical Field

The present disclosure relates to a printing apparatus.

2. Related Art

Conventionally, there have been used various printing apparatuses. Among the various printing apparatuses, there have been known a printing apparatus configured to perform printing on a medium that is wound in a roll shape, and a printing apparatus configured to wind a medium to which printing is applied in a roll shape. For example, JP-A-2012-166914 discloses a recording device configured to sequentially transport a rolled medium set at a feeding unit, to apply printing to the transported medium, and to wind the medium subjected to the printing in a roll shape by a winding device.

In a printing apparatus configured to hold a roll body of a medium, such as the recording device disclosed in JP-A-2012-166914, there exists a case where it is difficult to set a heavy roll body on a holding member, and there also exists a case where a roll body is not disposed at an accurate position. When the roll body is not disposed at an accurate position, there may be a case where a medium wound in a roll shape cannot be fed to an accurate position thus causing a defect in transporting operation and a case where a winding position is displaced in winding a medium in a roll shape thus causing a defect in winding operation. In view of the above-mentioned circumstances, it is an object of the present disclosure to provide a technique by which a roll body can be disposed at an accurate position.

SUMMARY

According to an aspect of the present disclosure, there is provided a printing apparatus comprising: an apparatus body including a printing unit configured to perform printing on a medium, and a roll body holder unit configured to move in a moving direction intersecting with a winding axis direction of the roll body along an installation surface of the apparatus body with respect to the apparatus body in a state where the roll body holder unit holds a roll body that is a roll of the medium, wherein the roll body holder unit includes: a holding member configured to hold the roll body in a rotatable manner, a contact portion configured to be brought into contact with the installation surface, and a shaft member extended in the winding axis direction at a position above the contact portion in a vertical direction, the apparatus body includes: a support portion configured to support the shaft member, and a fixing portion configured to fix the roll body holder unit, the shaft member is configured to be detachably attached to the support portion by moving the roll body holder unit in the moving direction with respect to the apparatus body, the roll body holder unit is configured to be rotatable between a first position and a second position with reference to the shaft member in a state where the shaft member is supported on the support portion, the first position is a position where the shaft member is attached to the support portion as the roll body holder unit approaches the apparatus body along the moving direction, and the second position is a position where the apparatus body fixes the roll body holder unit by the fixing portion, and is a position where the contact portion is separated from the installation surface or a force applied from the contact portion to the installation surface is lower compared to a case where the roll body holder unit is located at the first position.

BRIEF DESCRIPTION OF THE DRAWINGS

FIG. 2 is a schematic side cross-sectional view of a roll body holder unit of the printing apparatus according to the first embodiment of the present disclosure and an apparatus body around the roll body holder unit, wherein FIG. 2 is a view showing a state in which the apparatus body and the roll body holder unit are located at positions away from each other.

FIG. 3 is a schematic side cross-sectional view of the roll body holder unit of the printing apparatus according to the first embodiment of the present disclosure and the apparatus body around the roll body holder unit, wherein FIG. 3 is a view showing a state in which the roll body holder unit is located at a first position.

FIG. 4 is a schematic side cross-sectional view of the roll body holder unit of the printing apparatus according to the first embodiment of the present disclosure and the apparatus body around the roll body holder unit, wherein FIG. 4 is a view showing a state in which the roll body holder unit is located at a second position.

FIG. 5 is a schematic front view of a contact portion, a support portion, and the surrounding of the contact portion and the support portion of the printing apparatus according to the first embodiment of the present disclosure, wherein FIG. 5 is a view showing a positional relationship between the contact portion and the support portion that are provided to a leg portion and a first shaft member.

FIG. 6 is a schematic side cross-sectional view of a roll body holder unit of a printing apparatus according to a second embodiment of the present disclosure and an apparatus body around the roll body holder unit, wherein FIG. 6 is a view showing a state in which the roll body holder unit is located at a second position.

DESCRIPTION OF EXEMPLARY EMBODIMENTS

Figure 1:
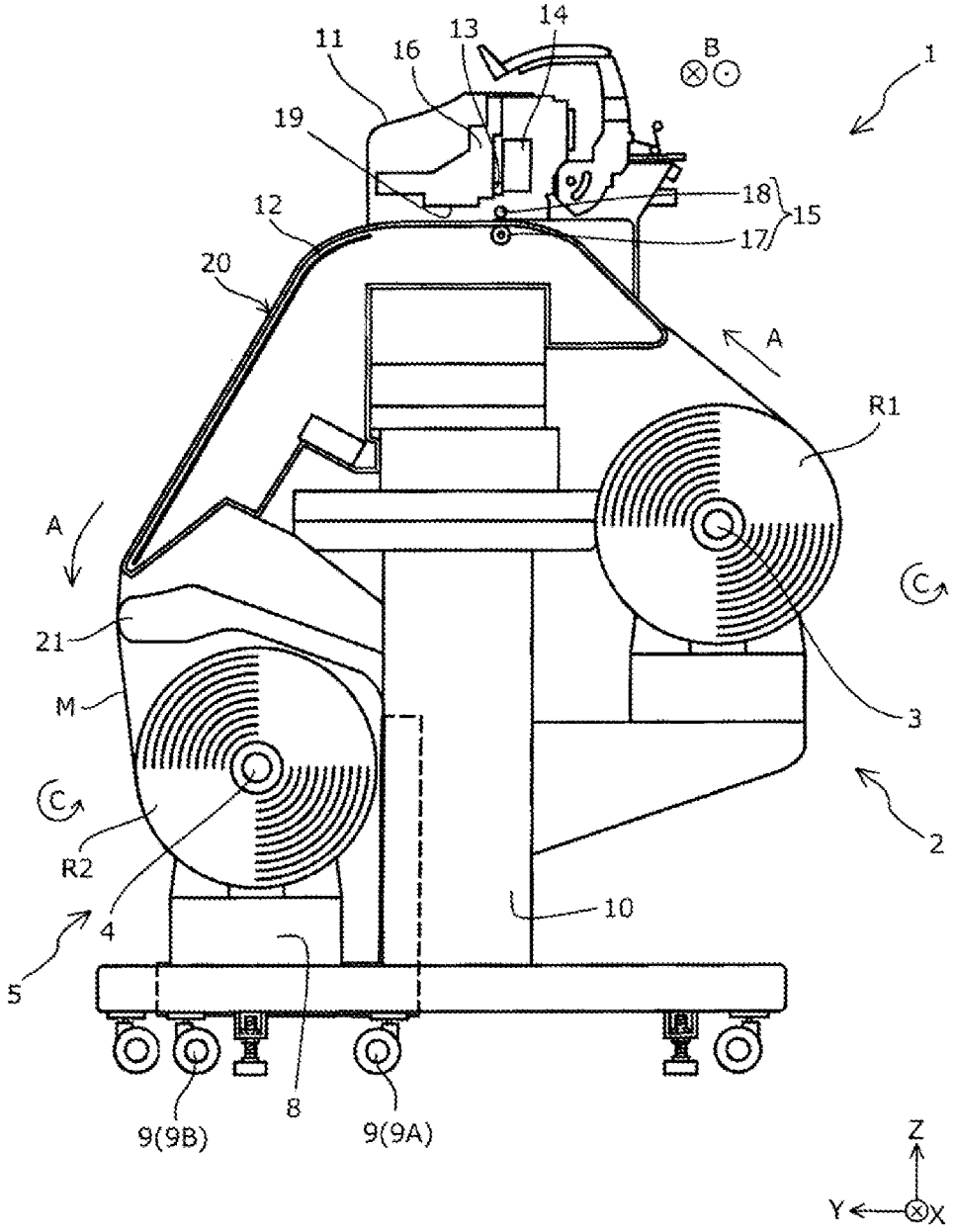
FIG. 1 is a side view of a printing apparatus according to a first embodiment of the present disclosure.

First, the present disclosure will be schematically described.

According to a first aspect of the present disclosure, there is provided a printing apparatus comprising: an apparatus body including a printing unit configured to perform printing on a medium, and a roll body holder unit configured to move in a moving direction intersecting with a winding axis direction of the roll body along an installation surface of the apparatus body with respect to the apparatus body in a state where the roll body holder unit holds a roll body that is a roll of the medium, wherein the roll body holder unit includes: a holding member configured to hold the roll body in a rotatable manner, a contact portion configured to be brought into contact with the installation surface, and a shaft member extended in the winding axis direction at a position above the contact portion in a vertical direction, the apparatus body includes: a support portion configured to support the shaft member, and a fixing portion configured to fix the roll body holder unit, the shaft member is configured to be detachably attached to the support portion by moving the roll body holder unit in the moving direction with respect to the apparatus body, the roll body holder unit is configured to be rotatable between a first position and a second position with reference to the shaft member in a state where the shaft member is supported on the support portion, the first position is a position where the shaft member is attached to the support portion as the roll body holder unit approaches the apparatus body along the moving direction, and the second position is a position where the apparatus body fixes the roll body holder unit by the fixing portion, and is a position where the contact portion is separated from the installation surface or a force applied from the contact portion to the installation surface is lower compared to a case where the roll body holder unit is located at the first position.

According to the present aspect, the roll body can be held on the roll body holder unit in a state where the roll body holder unit is disposed at a position away from the apparatus body. Accordingly, it is possible to suppress the occurrence of a phenomenon that the apparatus body becomes an obstacle in holding the roll body on the roll body holder unit whereby the operability at the time of holding the roll body on the roll body holder unit is lowered. Further, the shaft member can be supported on the support portion by bringing the roll body holder unit close to the apparatus body along the installation surface. Accordingly, the roll body holder unit can be easily positioned with respect to the apparatus body. Further, the roll body holder unit is fixed to the apparatus body at a plurality of positions of the fixing portion and the support portion and, at the same time, the roll body holder unit is fixed to the apparatus body at a position where a force applied to the installation surface from the contact portion is lower compared to a case in which the contact portion is separated from the installation surface or a case in which the roll body holder unit is located at the first position. Accordingly, the roll body holder unit can be firmly fixed to the apparatus body irrespective of a state of the installation surface.

Accordingly, the roll body can be easily disposed at an accurate position.

A printing apparatus according to a second aspect of the present invention is characterized in that, in the above-mentioned first aspect, the roll body holder unit includes a portion to be fixed at a position where the portion to be fixed is not brought into contact with the apparatus body when the roll body holder unit is located at the first position, the position being different from a position of the shaft member in the vertical direction, and the portion to be fixed is fixed to the fixing portion when the roll body holder unit is located at the second position.

According to the present aspect, the roll body holder unit includes the portion to be fixed that is fixed to the fixing portion when the roll body holder unit is located at the second position, at the position different from the position of the shaft member in the vertical direction. Accordingly, at the second position, the roll body holder unit can be firmly fixed to the apparatus body by the fixing portion and the portion to be fixed in addition to the support portion and the shaft member. Further, the portion to be fixed is located at a position where the portion to be fixed is not brought into contact with the apparatus body when the roll body holder unit is located at the first position. Accordingly, it is possible to suppress the occurrence of a phenomenon that the portion to be fixed interferes with the apparatus body when the shaft member is supported on the support portion by bringing the roll body holder unit close to the apparatus body along the installation surface.

A printing apparatus according to a third aspect of the present disclosure is characterized in that, in the above-mentioned second aspect, the portion to be fixed is disposed at a position above the shaft member in the vertical direction.

According to the present aspect, the portion to be fixed is disposed at a position above the shaft member in the vertical direction. With such a configuration, a load when the roll body holder unit is displaced from the first position to the second position can be reduced.

A printing apparatus according to a fourth aspect of the present disclosure is characterized in that, in the above-mentioned second and third aspects, the apparatus body includes a sensor configured to detect whether the portion to be fixed is at a position where the portion to be fixed is to be fixed to the fixing portion.

According to the present aspect, the apparatus body includes the sensor configured to detect whether the portion to be fixed is at a position where the portion to be fixed is to be fixed to the fixing portion. Accordingly, it is possible to suppress the occurrence of a phenomenon that a printing operation is started in a state where the roll body holder unit is not present at the second position that is a regular position, or the like.

A printing apparatus according to a fifth aspect of the present invention is characterized in that, in any one of the above-mentioned first to fourth aspects, the apparatus body includes a contact portion with which the shaft member is brought into contact when the shaft member is attached to the support portion as the roll body holder unit approaches the apparatus body along the moving direction.

According to the present aspect, the apparatus body includes the contact portion with which the shaft member is brought into contact when the shaft member is attached to the support portion. Accordingly, the roll body holder unit can be positioned with respect to the apparatus body by bringing the shaft member into contact with the contact portion and hence, positioning of the roll body holder unit with respect to the apparatus body can be facilitated.

A printing apparatus according to a sixth aspect of the present disclosure is characterized in that, in the above-mentioned fifth aspect, the contact portion has a guide structure for guiding the shaft member to the support portion when the shaft member is attached to the support portion.

According to the present aspect, the contact portion has the guide structure for guiding the shaft member to the support portion when the shaft member is attached to the support portion. Accordingly, particularly, positioning of the roll body holder unit with respect to the apparatus body can be facilitated.

A printing apparatus according to a seventh aspect of the present disclosure is characterized in that, in any one of the first to sixth aspects, the roll body holder unit includes a first contact portion and a second contact portion as the contact portion, and the shaft member, the first contact portion, the holding member, and the second contact portion are disposed in this order from a leading side in a direction that the roll body holder unit approaches the apparatus body along the moving direction.

According to the present aspect, the roll body holder unit includes the first contact portion and the second contact portion as the contact portion, and the shaft member, the first contact portion, the holding member, and the second contact portion are disposed in this order from the leading side in the direction that the roll body holder unit approaches the apparatus body along the moving direction. Accordingly, by sandwiching the holding member between the first contact portion and the second contact portion, the stability of the roll body holder unit is enhanced and, at the same time, by disposing the shaft member on the leading side, the operability at the time of displacing the roll body holder unit from the first position to the second position can be enhanced.

First Embodiment

Hereinafter, an embodiment according to the present disclosure will be described in detail with reference to drawings. First, a printing apparatus 1 according to a first embodiment of the present disclosure is described with reference to FIG. 1. Here, in FIG. 1, some constitutional members are omitted for facilitating the understanding of the configuration. Here, in the drawing, an X-axis direction is a horizontal direction, and corresponds to a winding axis direction B parallel to an extending direction of a holding member 3 on which a roll body R1 of a medium M to be subjected to printing is set, and an extending direction of a holding member 4 that is configured to wind the medium M subjected to the printing as a roll body R2. A Y-axis direction is a horizontal direction, and corresponds to a direction orthogonal to the X-axis direction. Further, a Z-axis direction is a vertical direction. Still further, in the description made hereinafter, an arrow direction is assumed as a + direction, and a direction opposite to the arrow direction is assumed as a − direction. For example, a vertically upward direction is assumed as a +Z direction, and a vertically downward direction is assumed as a −Z direction.

The printing apparatus 1 of the present embodiment includes the holding member 3 configured to hold the roll body R1 formed by winding a sheet-like medium M for printing. Further, in the printing apparatus 1 of the present embodiment, when the medium M is transported in a transport direction A, the holding member 3 is rotated in a rotation direction C. Here, in the present embodiment, the roll body R1 formed by winding the medium M such that a printing surface on which printing is to be applied is disposed outside is used. However, in a case where a roll body R1 in which the medium M is wound such that a printing surface is disposed inside is used, the medium M can be fed from the roll body R1 by rotating the holding member 3 in a direction opposite to the rotation direction C.

The printing apparatus 1 of the present embodiment includes a transport path for the medium M that is formed of a medium support portion 20 for supporting the medium M, and the like. Further, the printing apparatus 1 includes a pair of transport rollers 15 constituted of a drive roller 17 and a driven roller 18 for transporting the medium M in the transport direction A in the transport path. In the printing apparatus 1 according to the present embodiment, the drive roller 17 is constituted of a roller extending in the winding axis direction B intersecting with the transport direction A, and the driven roller 18 is constituted by arranging a plurality of rollers in the winding axis direction B with respect to the drive roller 17 at positions facing the drive roller 17. However, a configuration of a transport unit for the medium M is not particularly limited.

Further, on a lower portion of the medium support portion 20, a heater 12 capable of heating the medium M supported on the medium support portion 20 is disposed. However, a configuration having no heating unit for heating the medium M may be adopted.

Further, the printing apparatus 1 according to the preset embodiment includes, inside a housing portion 11, a head 19 that forms a printing unit provided with a plurality of nozzles and configured to perform printing by ejecting inks from the nozzles, and a carriage 16 on which the head 19 is mounted and that is configured to move in the winding axis direction B in a reciprocating manner. In the printing apparatus 1 according to the present embodiment, the transport direction A at a position on the medium support portion 20 facing the head 19 is a +Y axis direction, a moving direction of the head 19 is an X axis direction corresponding to the winding axis direction B, an ink ejecting direction is a −Z direction.

Here, inside the housing portion 11, a frame 14 is formed, and a guide rail 13 attached to the frame 14 and extending in the X axis direction is formed. Further, the carriage 16 provided with the head 19 is attached to the guide rail 13.

With the above-mentioned configuration, the head 19 is capable of performing printing by ejecting inks to the transported medium M from the nozzles not illustrated in the drawing while moving in the winding axis direction B intersecting with the transport direction A in a reciprocating manner. The printing apparatus 1 according to the present embodiment is capable of forming a desired image on the medium M by performing an operation of transporting the medium M in the transport direction A by a predetermined transport amount and an operation of ejecting inks while moving the head 19 in the winding axis direction B in a state where the medium M is stopped, in a repeated manner.

Further, on a downstream side of the head 19 in the transport direction A, the holding member 4 configured to wind the medium M on which an image is formed by ejecting inks from the head 19, as the roll body R2, is provided. Here, in the present embodiment, the medium M is wound such that the printing surface is disposed outside. Accordingly, when the medium M is wound, the holding member 4 is rotated in the rotation direction C. On the other hand, when the medium M is wound such that the printing surface is disposed inside, the holding member 4 is capable of winding the medium M by rotating in a direction opposite to the rotation direction C.

Further, between an end portion of the medium support portion 20 on a downstream side in the transport direction A and the holding member 4, a tension bar 21 is provided. A portion of the tension bar 21 that is brought into contact with the medium M is extended in the winding axis direction B, and the tension bar 21 is configured to apply desired tension to the medium M. However, a configuration having no tension bar 21 may be adopted.

Here, the printing apparatus 1 according to the present embodiment is provided with the apparatus body 2 including the head 19 and the like, and a roll body holder unit 5 including the holding member 4. The roll body holder unit 5 is configured to be detachably attached to the apparatus body 2. Hereinafter, the roll body holder unit 5 and an attachment portion of the apparatus body 2 to which the roll body holder unit 5 is attached are described in detail with reference to FIG. 3 to FIG. 5.

Here, in the printing apparatus 1 according to the present embodiment, the roll body holder unit 5 is configured to include the holding member 4. However, instead of providing the holding member 3 to the apparatus body 2, the holding member 3 may be provided to the roll body holder unit 5. For this reason, in the description made hereinafter, a configuration where the holding member 3 is provided to the roll body holder unit 5 can be understood by regarding the holding member 4 as the holding member 3. A configuration may be adopted where a roll body holder unit 5 provided with the holding member 3 is used together with the roll body holder unit 5 provided with the holding member 4. Further, a configuration may be adopted where the holding member 4 is provided to the apparatus body 2 and, further, a roll body holder unit 5 provided with the holding member 3 is used.

Figure 2:
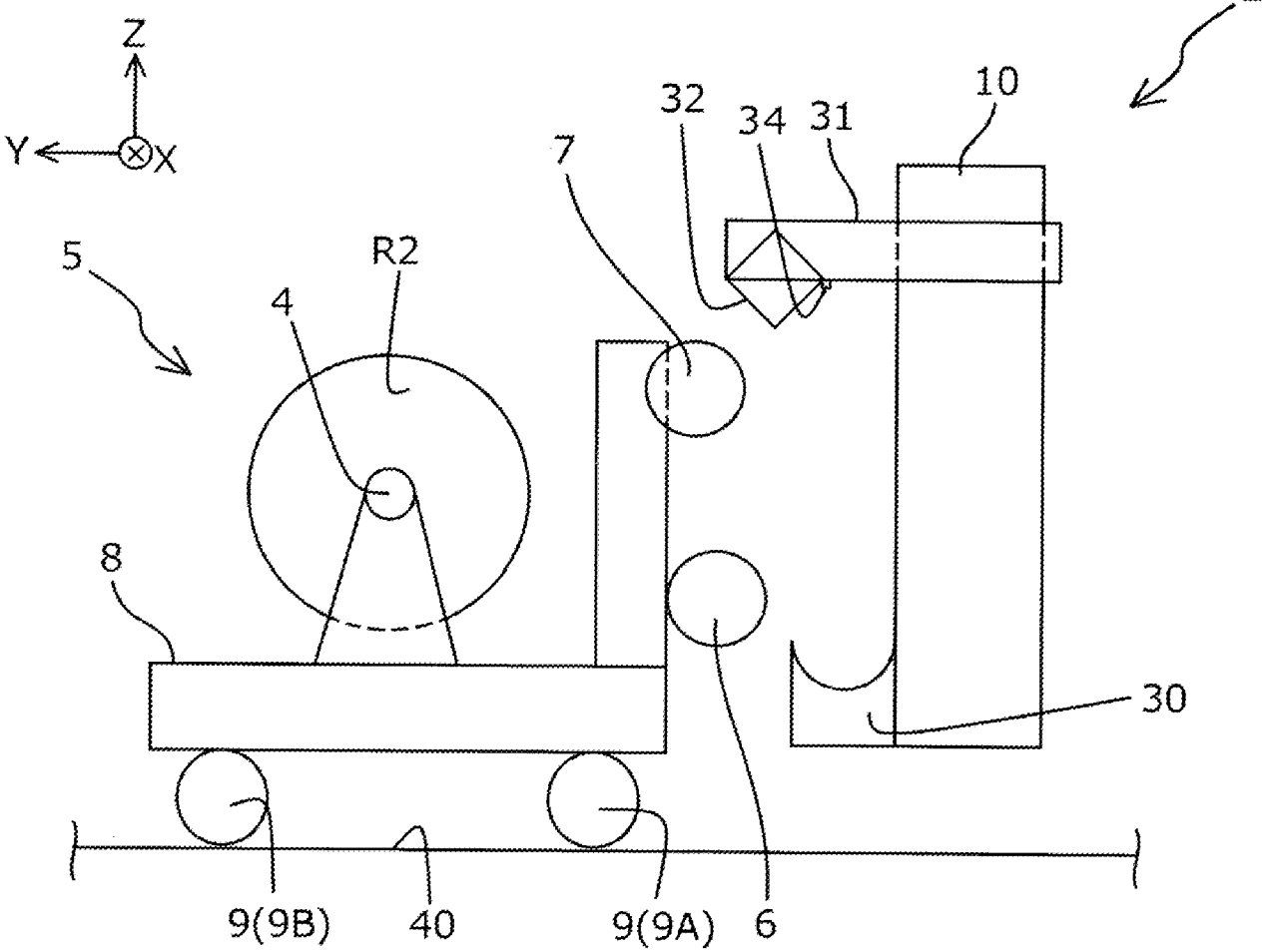
Figure 3:
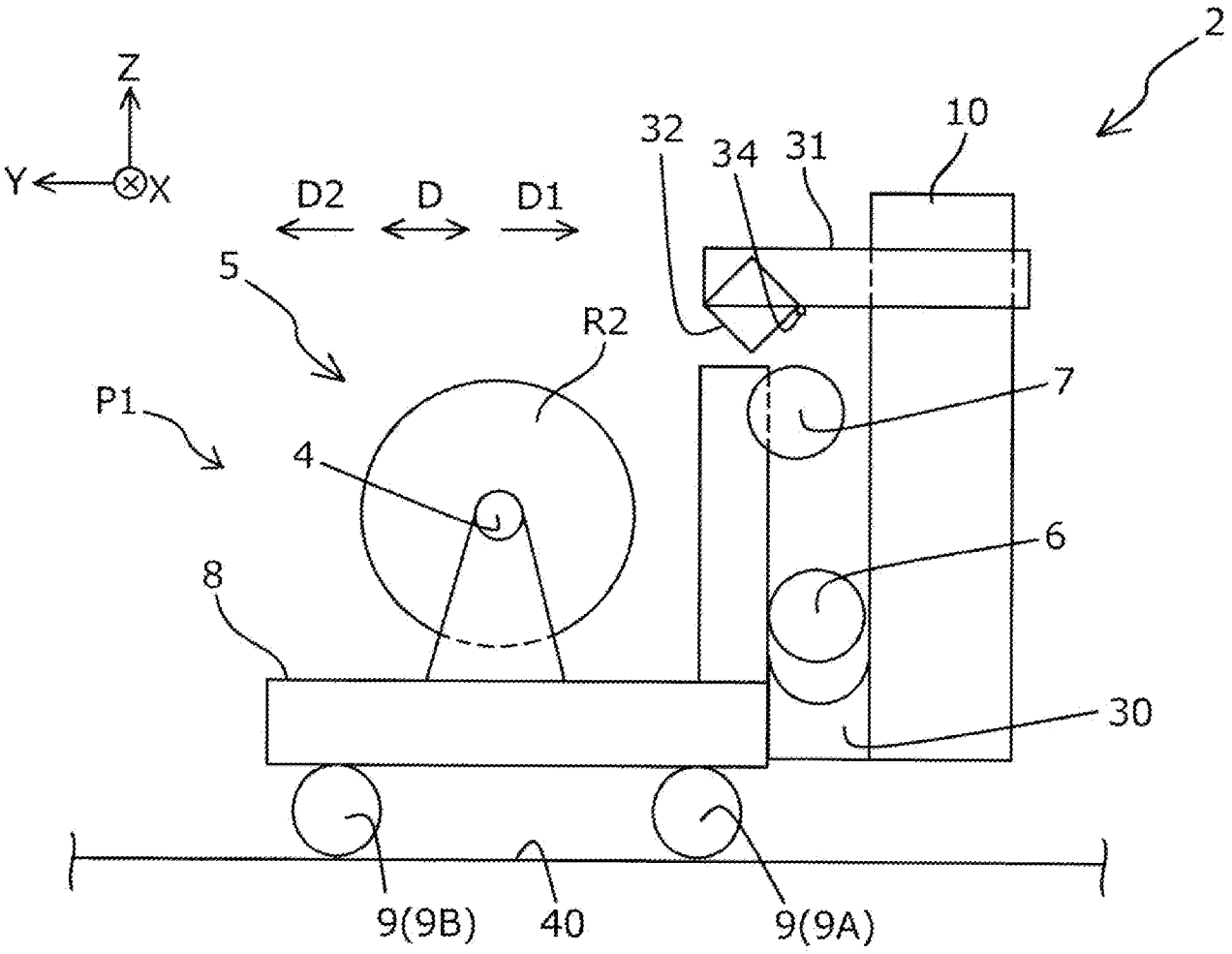
Figure 4:
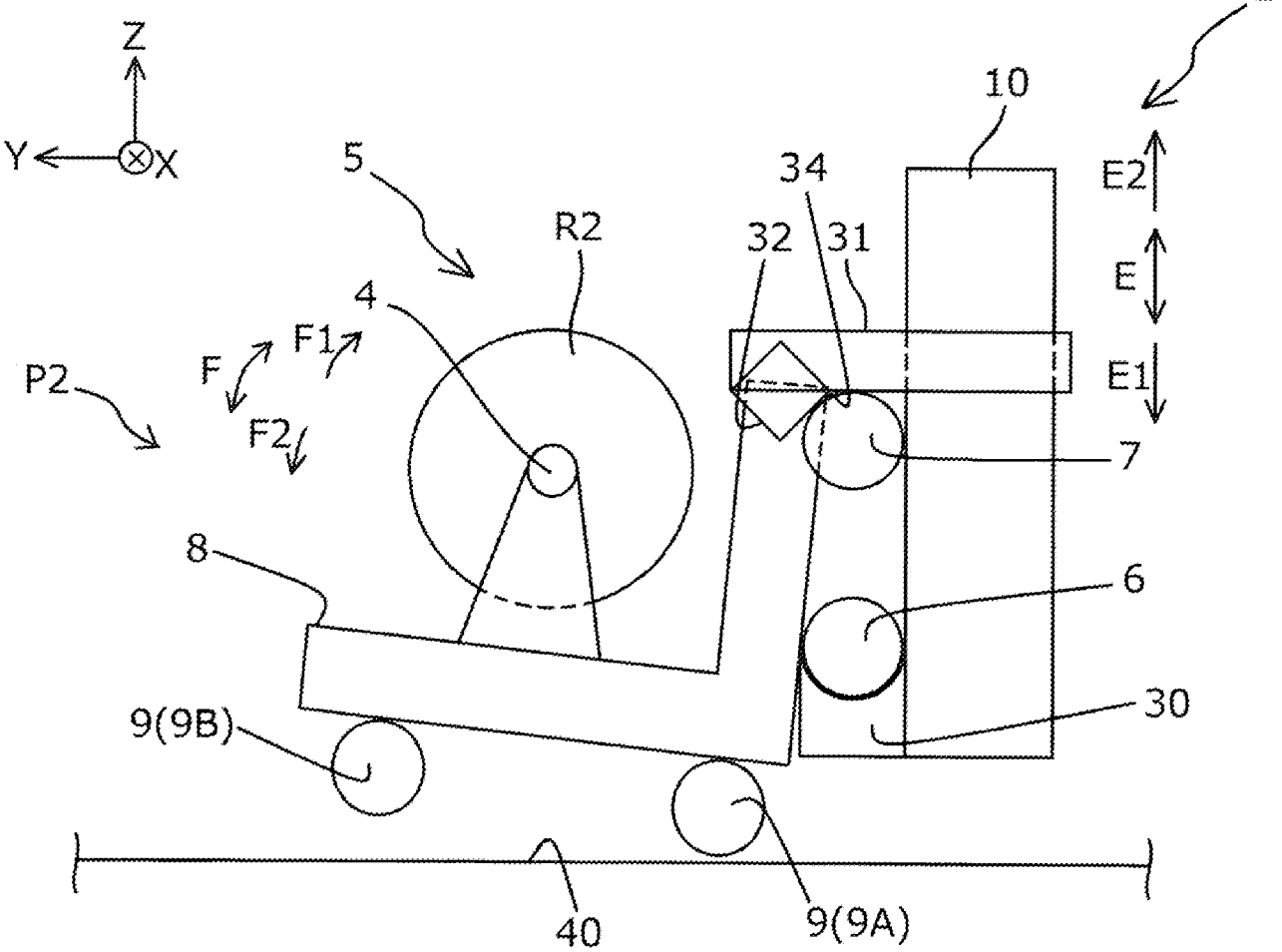

As illustrated in FIG. 2 to FIG. 4, the roll body holder unit 5 includes a base portion 8, and the base portion 8 includes the holding member 4, a first shaft member 6, a second shaft member 7, and wheels 9. The first shaft member 6 and the second shaft member 7 are extended in the winding axis direction B corresponding to the X-axis direction. The roll body holder unit 5 includes, as the wheels 9, a wheel 9A on both end portions in the X axis direction on the −Y direction side, and a wheel 9B on both end portions in the X-axis direction on the +Y direction side. That is, the roll body holder unit 5 includes four wheels 9 in total. Here, in the printing apparatus 1 according to the present embodiment, a configuration where the wheels 9 are provided as a contact portion with respect to the installation surface 40 of the printing apparatus 1 is adopted. However, the configuration of the printing apparatus 1 is not limited to such a configuration. For example, a slider, a caster other than the wheel 9, or the like capable of causing the printing apparatus 1 to slide with respect to the installation surface 40, a rail provided to the installation surface 40, or the like can also be used, as the contact portion, instead of the wheels 9.

Figure 5:
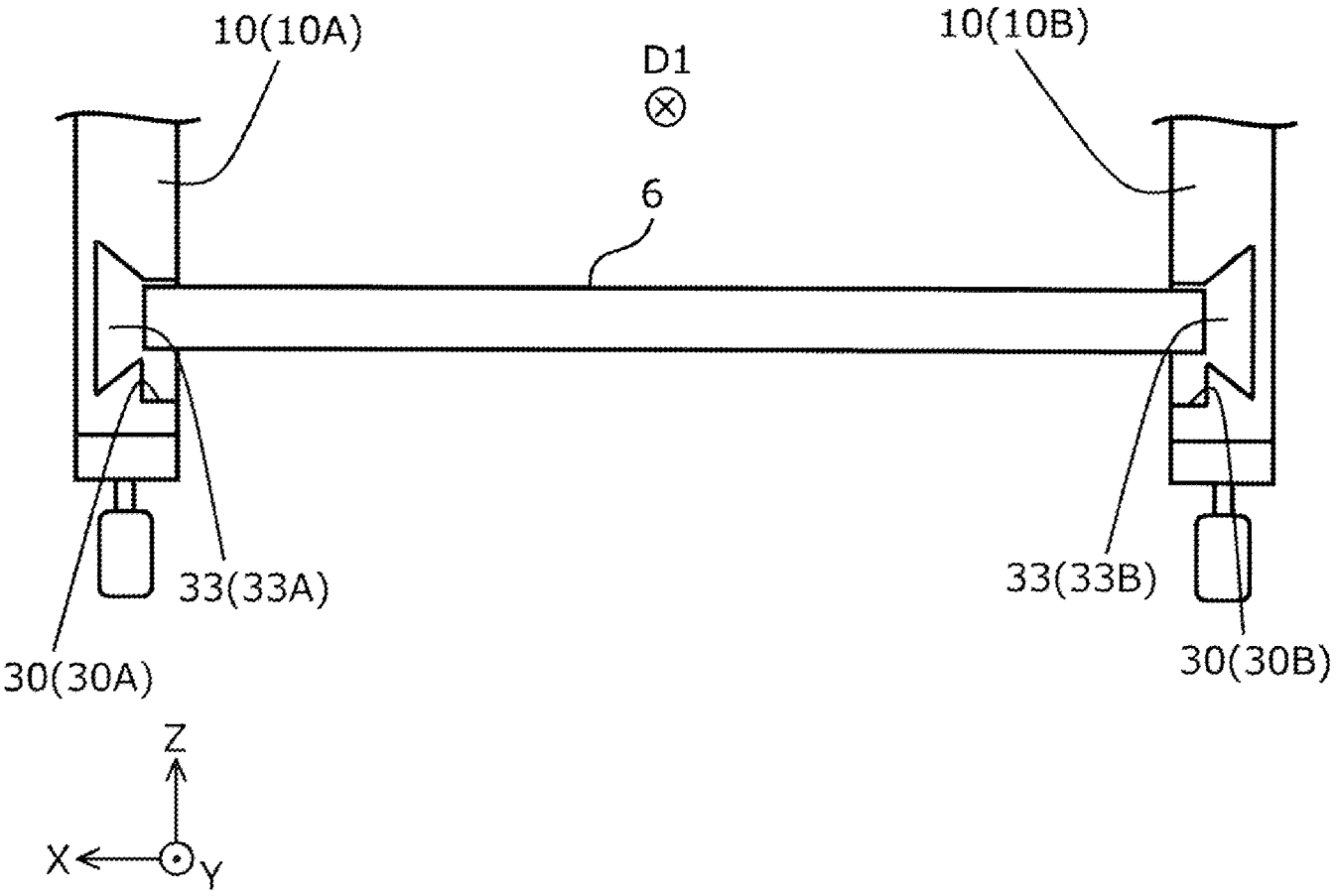

As illustrated in FIG. 2 to FIG. 4, the apparatus body 2 includes the leg portion 10, and the leg portion 10 includes a support portion 30 configured to rotatably support the first shaft member 6, and a fixing portion 31 configured to fix the second shaft member 7. As illustrated in FIG. 5, the printing apparatus 1 according to the present embodiment includes, as the leg portion 10, a leg portion 10A on the +X direction side, and a leg portion 10B on the −X direction side, and includes, as the support portion 30, a support portion 30A provided to the leg portion 10A, and a support 30B provided to the leg portion 10B.

Further, as illustrated in FIG. 5, on the leg portion 10A, a contact portion 33A is formed at a position where the leg portion 10A can be brought into contact with the first shaft member 6. The contact portion 33A is formed so as to be positioned on a −X direction side and have a gap thereof in the Z axis direction gradually narrowed, as the contact portion 33A extends toward the −Y direction side. Further, as illustrated in FIG. 5, on the leg portion 10B, a contact portion 33B is formed at a position where the leg portion 10B can be brought into contact with the first shaft member 6. The contact portion 33B is formed so as to be positioned on a +X direction side and have a gap thereof in the Z axis direction gradually narrowed, as the contact portion 33B extends toward the −Y direction side. With such a configuration, as the contact portion 33A and the contact portion 33B extend toward the −Y direction side, a distance between the contact portion 33A and the contact portion 33B is gradually narrowed, and the gap of each of the contact portion 33A and the contact portion 33B in the Z axis direction is also gradually narrowed.

Further, the support portion 30A is formed at a position of the leg portion 10A below a leading side of the contact portion 33A on the −Y direction side, and the support portion 30B is formed at a position of the leg portion 10B below a leading side of the contact portion 33B on the −Y direction side. With such a configuration, an operator can easily support the first shaft member 6 on the support portion 30 by pressing the first shaft member 6 in an attaching direction D1 while bringing the first shaft member 6 into contact with at least one contact portion 33 out of the contact portion 33A and the contact portion 33B when the user attaches the roll body holder unit 5 to the apparatus body 5.

Here, the description will be made with respect to the procedure in attaching the roll body holder unit 5 to the apparatus body 2 with reference to FIG. 2 to FIG. 4. FIG. 2 illustrates a state in which the roll body holder unit 5 is removed from the apparatus body 2. As described above, the roll body holder unit 5 is provided with four wheels 9, in total, at both end portions in the X-axis direction and at both end portions in the Y-axis direction. Accordingly, the roll body holder unit 5 can be stably installed on the installation surface 40. Further, as illustrated in FIG. 2, in a state where the roll body holder unit 5 is removed from the apparatus body 2, the operator can easily attach and detach the roll body R2 to and from the holding member 4. Here, attaching and detaching of the roll body R2 include attaching and detaching of a winding shaft in a state where the winding shaft have no medium M, such as a paper tube for winding the medium M.

Next, FIG. 3 illustrates a state where the roll body holder unit 5 is moved in an attaching direction D1 in a moving direction D from the state illustrated in FIG. 2, and the first shaft member 6 is brought into contact with a portion of the support portion 30 and is supported on the support portion 30. Here, the state where the first shaft member 6 is supported on the support portion 30 also includes a state just before the first shaft member 6 is brought into contact with the support portion 30, that is, a state where at least a portion of the first shaft member 6 is separated from the support portion 30 as illustrated in FIG. 3. The state illustrated in FIG. 3 corresponds to a state where the roll body holder unit 5 is located at a first position P1, and shows a state where all of the four wheels 9 are brought into contact with the installation surface 40. However, depending on a state of a planar surface of the installation surface 40, any one of the four wheels 9 may be separated from the installation surface 40.

Further, FIG. 4 illustrates a state where the roll body holder unit 5 is fixed to the apparatus body 2. Specifically, the fixing portion 31 provided to the apparatus body 2 is moved in a fixing direction E1 in a moving direction E from the state illustrated in FIG. 3 so that a protruding portion 32 provided to the fixing portion 31 is pressed down while being brought into contact with the second shaft member 7. With such an operation, the first shaft member 6 is firmly pressed downward with respect to the support portion 30, and the second shaft member 7 is firmly pressed downward by the fixing portion 31 and hence, and the roll body holder unit 5 is fixed to the apparatus body 2. Here, by pressing the fixing portion 31 in the fixing direction E1 while bringing the protruding portion 32 into contact with the second shaft member 7, the roll body holder unit 5 is rotated in the rotation direction F1 in the rotation direction F with reference to the first shaft member 6. The state illustrated in FIG. 4 corresponds to a state where the roll body holder unit 5 is located at a second position P2, and shows a state where the roll body holder unit 5 is fixed to the apparatus body 2, and all of the four wheels 9 are separated from the installation surface 40. However, depending on a configuration of the contact portion such as the wheels 9, any one of or all of the four wheels 9 may be brought into contact with the installation surface 40.

In the state illustrated in FIG. 4, the roll body holder unit 5 is firmly fixed to the apparatus body 2 by the first shaft member 6 and the second shaft member 7. As described above, the apparatus body 2 includes two leg portions 10A and 10B and hence, the first shaft member 6 and the second shaft member 7 are fixed to the apparatus body 2 at two portions respectively. That is, the roll body holder unit 5 is fixed to the apparatus body 2 at four portions.

Here, the above-mentioned description is a description with respect to the procedure in attaching the roll body holder unit 5 to the apparatus body 2. However, the procedure in detaching the roll body holder unit 5 from the apparatus body 2 is as follows. First, the fixing portion 31 is moved in an opening direction E2 in the moving direction E from the state illustrated in FIG. 4. Then, the roll body holder unit 5 is rotated in the rotation direction F2 in the rotation direction F. That is, the roll body holder unit 5 is rotated to the first position P1 illustrated in FIG. 3 from the second position P2 illustrated in FIG. 4. Further, by moving the roll body holder unit 5 in a detaching direction D2 in the moving direction D, the roll body holder unit 5 is detached from the apparatus body 2 as illustrated in FIG. 2.

Here, to temporarily summarize the above-mentioned configuration, the printing apparatus 1 according to the present embodiment includes the apparatus body 2 provided with the head 19 configured to perform printing on the medium M, and the roll body holder unit 5 configured to move, with respect to the apparatus body 2, in the moving direction D intersecting with the winding axis direction B of the roll body R2 along the installation surface 40 of the apparatus body 2 in a state where the roll body R2 that is a rolled medium M is held on the roll body holder unit 5. Further, the roll body holder unit 5 includes the holding member 4 configured to rotatably hold the roll body R2, the wheels 9, as the contact portion, configured to be brought into contact with the installation surface 40, and the first shaft member 6 extended in the winding axis direction B at a position above the wheels 9 in the vertical direction. The apparatus body 2 includes the support portion 30 configured to support the first shaft member 6, and the fixing portion 31 configured to fix the roll body holder unit 5.

Further, as described above, the first shaft member 6 is configured to be attached to and detached from the support portion 30 by moving the roll body holder unit 5 along the moving direction D with respect to the apparatus body 2. Further, the roll body holder unit 5 is configured to be rotatable between the first position P1 and the second position P2 with reference to the first shaft member 6 in a state where the first shaft member 6 is supported on the support portion 30. Here, the first position P1 is a position where the first shaft member 6 is attached to the support portion 30 as the roll body holder unit 5 approaches the apparatus body 2 along the moving direction D. Further, the second position P2 is a position where the apparatus body 2 fixes the roll body holder unit 5 by the fixing portion 31, and the wheels 9, as the contact portion, are separated from the installation surface 40. However, at the second position P2, the contact portion may not be separated from the installation surface 40 depending on a configuration and the like of the contact portion as described above, and it is sufficient for the second position P2 to be a position where a force applied to the installation surface 40 from the contact portion is lower compared to a case where the roll body holder unit 5 is located at the first position P1.

Here, "the roll body holder unit 5 is rotatable between the first position P1 and the second position P2 with reference to the first shaft member 6" means that it is sufficient for the roll body holder unit 5 to be rotatable between the first position P1 and the second position P2 while allowing the slight movement of the first shaft member 6 caused when the roll body holder unit 5 is rotated. Also in the printing apparatus 1 of the present embodiment, when the roll body holder unit 5 is rotated to the first position P1 or the second position P2 with reference to the first shaft member 6, the position of the first shaft member 6 slightly moves in the vertical direction.

As described above, the printing apparatus 1 of the present embodiment is configured to hold the roll body R2 on the roll body holder unit 5 in a state where the roll body holder unit 5 is disposed at a position away from the apparatus body 2. Accordingly, it is possible to suppress the occurrence of a phenomenon that the apparatus body 2 becomes an obstacle in holding the roll body R2 on the roll body holder unit 5 whereby the operability at the time of holding the roll body R2 on the roll body holder unit 5 is lowered. Further, the first shaft member 6 can be supported on the support portion 30 by bringing the roll body holder unit 5 close to the apparatus body 2 along the installation surface 40. Accordingly, the roll body holder unit 5 can be easily positioned with respect to the apparatus body 2. Further, the printing apparatus 1 of the present embodiment is configured such that the roll body holder unit 5 is fixed to the apparatus body 2 at a plurality of positions, that is, the fixing portion 31 and the support portion 30 and, at the same time, the roll body holder unit 5 is fixed to the apparatus body 2 at a position where a force applied to the installation surface 40 from the contact portion is lower compared to a case in which the contact portion is separated from the installation surface 40 or a case in which the roll body holder unit 5 is located at the first position P1. Accordingly, the roll body holder unit 5 can be firmly fixed to the apparatus body 2 irrespective of a state of the installation surface 40. Accordingly, according to the printing apparatus 1 of the present embodiment, the roll body can be easily disposed at an accurate position.

Here, as described above, the "roll body" may be either one of the roll body R1 of the medium M before being subjected to printing and the roll body R2 formed by winding the medium M after being subjected to printing. Accordingly, although the roll body holder unit 5 of the present embodiment is configured to hold the roll body R2 formed by winding the medium M by the holding member 4. However, a roll body holder unit having substantially the same configuration as the roll body holder unit 5, other than a configuration that the holding member 3 as the feeding unit for feeding the medium M is provided instead of the holding member 4, may be provided.

Further, as illustrated in FIG. 2 to FIG. 4, in the printing apparatus 1 of the present embodiment, the roll body holder unit 5 includes the second shaft member 7 at a position where the second shaft member 7 is not brought into contact with the apparatus body 2 when the roll body holder unit 5 is located at the first position P1, the position being different from a position of the first shaft member 6 in the Z axis direction corresponding to the vertical direction, and the second shaft member 7 functions as the portion to be fixed that is fixed to the fixing portion 31 when the roll body holder unit 5 is located at the second position P2. Accordingly, according to the printing apparatus 1 of the present embodiment, the roll body holder unit 5 can be firmly fixed to the apparatus body 2 at the second position P2 by the fixing portion 31 and the second shaft member 7 in addition to the support portion 30 and the first shaft member 6. Further, as illustrated in FIG. 3, the second shaft member 7 is located at a position where the second shaft member 7 is not brought into contact with the apparatus body 2 when the roll body holder unit 5 is located at the first position P1. Accordingly, in the printing apparatus 1 of the present embodiment, it is possible to suppress the occurrence of a phenomenon that the second shaft member 7 interferes with the apparatus body 2 when the first shaft member 6 is supported on the support portion 30 by bringing the roll body holder unit 5 close to the apparatus body 2 along the installation surface 40.

Here, to be more specific, as illustrated in FIG. 2 to FIG. 4, the second shaft member 7 is disposed at a position above the first shaft member 6 in the vertical direction. With such a configuration, when the user displaces the roll body holder unit 5 to the second position P2 illustrated in FIG. 4 from the first position P1 illustrated in FIG. 3, it is sufficient for the operator to perform a simple operation, that is, it is sufficient for the operator to merely press down the fixing portion 31 by applying his own weight to the fixing portion 31 and hence, the operability when the operator presses down the fixing portion 31 is enhanced whereby a load at the time of displacing the roll body holder unit 5 from the first position P1 to the second position P2 can be reduced.

Further, as illustrated in FIG. 2 to FIG. 4, the printing apparatus 1 of the present embodiment includes, at the fixing portion 31 of the apparatus body 2, a sensor 34 configured to detect whether the second shaft member 7 is at a position where the second shaft member 7 is to be fixed to the fixing portion 31. Accordingly, it is possible to suppress the occurrence of a phenomenon that a printing operation is started in a state where the roll body holder unit 5 is not at the second position P2 that is a regular position, or the like. Further, it is also possible to detect that the roll body R2 is positioned at the accurate position. Accordingly, an image can be formed at an accurate position with respect to the medium M. Here, the sensor 34 of the present embodiment is configured to detect whether the second shaft member 7 is at a position where the second shaft member 7 is fixed to the fixing portion 31 by bringing the second shaft member 7 into contact with the position. However, the present disclosure is not limited to such a configuration, an optical sensor, or the like, configured to detect the presence or absence of the second shaft member 7 in a non-contact manner with respect to the second shaft member 7 may be used.

Further, as illustrated in FIG. 5, the printing apparatus 1 of the present embodiment includes, on the leg portion 10 of the apparatus body 2, the contact portion 33 with which the first shaft member 6 is brought into contact, when the first shaft member 6 is attached to the support portion 30 as the roll body holder unit 5 moves in the attaching direction D1 with respect to the apparatus body 2. Accordingly, according to the printing apparatus 1 of the present embodiment, the roll body holder unit 5 can be positioned with respect to the apparatus body 2 by bringing the first shaft member 6 into contact with the contact portion 33 and hence, positioning of the roll body holder unit 5 with respect to the apparatus body 2 can be facilitated.

Further, as illustrated in FIG. 5, on the leg portion 10, the contact portion 33 having the gap in the Z axis direction gradually narrowed as the contact portion 33 extends toward the −Y direction side is formed at a position where the leg portion 10 can be brought into contact with the first shaft member 6. Further, the distance between the two contact portions 33 in the X-axis direction is gradually narrowed as the contact portions 33 extend toward the −Y direction side. That is, in the printing apparatus 1 of the present embodiment, a guide structure for guiding the first shaft member 6 to the support portion 30 when the first shaft member 6 is attached to the support portion 30 is formed in the contact portion 33. Accordingly, according to the printing apparatus 1 of the present embodiment, particularly, positioning of the roll body holder unit 5 with respect to the apparatus body 2 can be facilitated. However, the configuration of the contact portion 33 is not limited to the configuration of the present embodiment. The guide structure may not be formed in the contact portion 33, and also the position of the contact portion 33 is not limited to a position where the contact portion 33 is brought into contact with the end portion of the first shaft member 6.

As illustrated in FIG. 2 to FIG. 4, in the printing apparatus 1 of the present embodiment, the roll body holder unit 5 includes, as the wheel 9 forming the contact portion, the wheels 9A as the first contact portion and the wheels 9B as the second contact portion. Further, as illustrated in FIG. 3, the first shaft member 6, the wheels 9A, the holding member 4, and the wheels 9B are disposed in this order from the leading side in the attaching direction D1 that the roll body holder unit 5 approaches the apparatus body 2 along the moving direction D. Accordingly, in the printing apparatus 1 of the present embodiment, the stability of the roll body holder unit 5 is enhanced by sandwiching the holding member 4 between the wheels 9A and the wheels 9B, and by disposing the first shaft member 6 on the leading side in the attaching direction D1, the operability at the time of displacing the roll body holder unit 5 from the first position P1 illustrated in FIG. 3 to the second position P2 illustrated in FIG. 4 can be enhanced.

Second Embodiment

Figure 6:
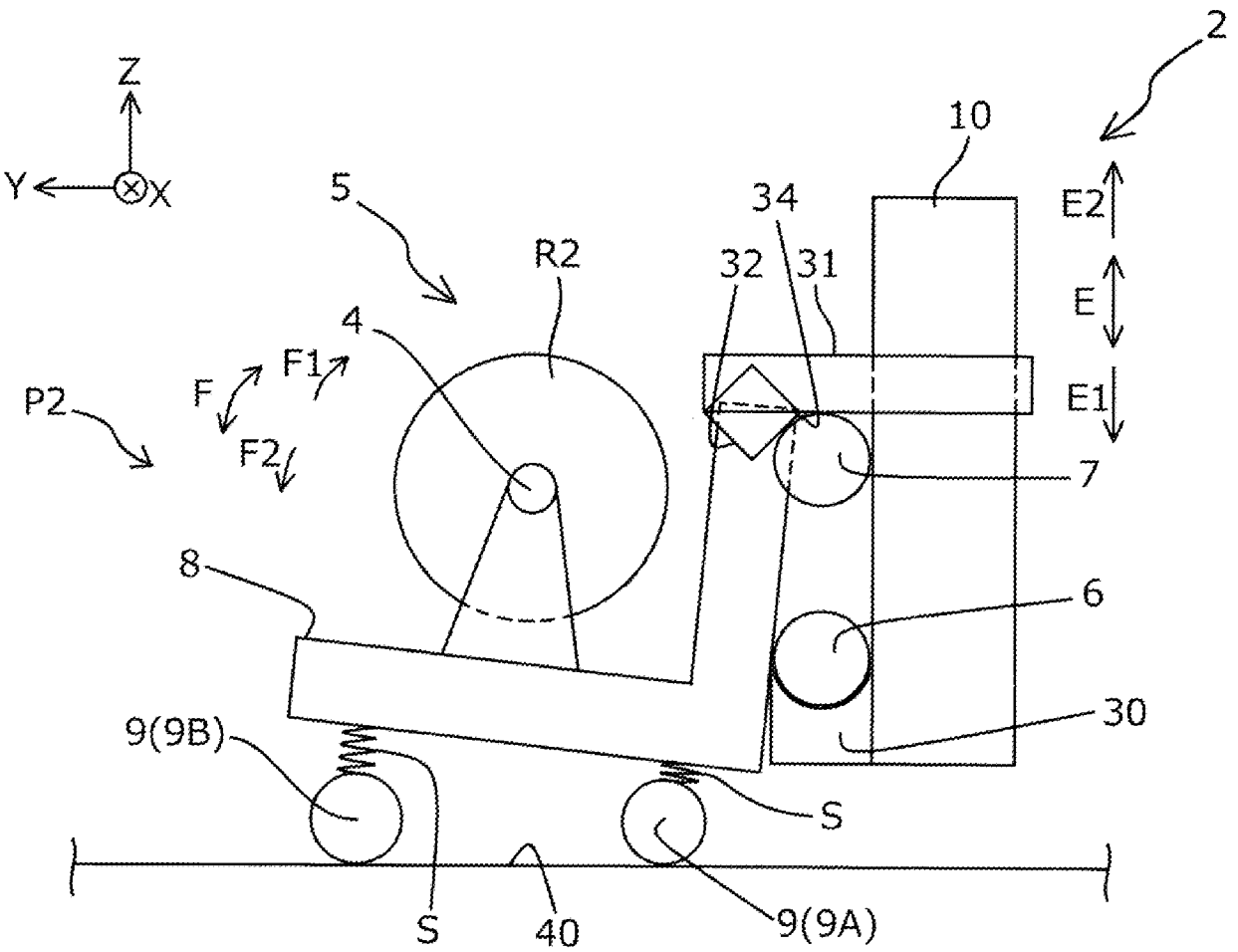

Next, a printing apparatus 1 according to a second embodiment will be described with reference to FIG. 6. Here, FIG. 6 is a view corresponding to FIG. 4 illustrating the printing apparatus 1 of the first embodiment. In FIG. 6, the constituent members common to those in the first embodiment described above are denoted by the same reference numerals, and their detailed description will be omitted. Here, the printing apparatus 1 of the present embodiment has substantially the same configuration as the printing apparatus 1 of the first embodiment other than a configuration of a wheel 9 as a contact portion. Accordingly, the printing apparatus 1 of the present embodiment has substantially the same features as the printing apparatus 1 of the first embodiment with respect to a configuration other than a configuration described below.

As illustrated in FIG. 6, in the printing apparatus 1 of the present embodiment, a spring member S is provided to each wheel 9. Accordingly, also in a case where a roll body holder unit 5 is located at a second position, the wheels 9 and an instillation surface 40 are brought into contact with each other. With such a configuration, the second position P2 is a position where, although the wheels 9 are not separated from the installation surface 40 in the same manner as the printing apparatus 1 of the first embodiment, a force applied from the wheel 9 to the installation surface 40 is lower compared to the case where the roll body holder unit 5 is located at the first position P1. To describe such a configuration from another point of view, each of the wheels 9 receives a part of the force applied to the installation surface 40 from the roll body holder unit 5 at the second position P2. Accordingly, the load applied to the apparatus body 2 such as the leg portion 10 by the roll body holder unit 5 can be reduced compared to the printing apparatus 1 of the first embodiment.

The present disclosure is not limited to the above-mentioned embodiments, and can be realized in various configurations without departing from the gist of the present disclosure. For example, appropriate replacements or combinations may be made to the technical features in the present embodiment that corresponds to the technical features in the respective aspects described in the SUMMARY section to solve some or all of the problems described above or to achieve some or all of the advantageous effects described above. Further, when the technical features are not described herein as essential technical features, such technical features may be deleted appropriately.

What is claimed is:

1. A printing apparatus comprising:

an apparatus body including a printing unit configured to perform printing on a medium; and a roll body holder unit configured to move in a moving direction intersecting with a winding axis direction of the roll body along an installation surface of the apparatus body with respect to the apparatus body in a state where the roll body holder unit holds a roll body that is a roll of the medium, wherein the roll body holder unit includes: a holding member configured to hold the roll body in a rotatable manner; a contact portion configured to be brought into contact with the installation surface; and a shaft member extended in the winding axis direction at a position above the contact portion in a vertical direction, the apparatus body includes: a support portion configured to support the shaft member; and a fixing portion configured to fix the roll body holder unit, the shaft member is detachably attached to the support portion by moving the roll body holder unit in the moving direction with respect to the apparatus body, the roll body holder unit is rotatable between a first position and a second position with reference to the shaft member in a state where the shaft member is supported on the support portion, the first position is a position where the shaft member is attached to the support portion as the roll body holder unit approaches the apparatus body along the moving direction, and the second position is a position where the apparatus body fixes the roll body holder unit by the fixing portion, and is a position where the contact portion is separated from the installation surface or a force applied from the contact portion to the installation surface is lower compared to a case where the roll body holder unit is located at the first position.

2. The printing apparatus according to claim 1, wherein the roll body holder unit includes a portion to be fixed at a position where the portion to be fixed is not brought into contact with the apparatus body when the roll body holder unit is located at the first position, the position being different from a position of the shaft member in the vertical direction, the portion to be fixed being fixed to the fixing portion when the roll body holder unit is located at the second position.

3. The printing apparatus according to claim 2, wherein the portion to be fixed is disposed at a position above the shaft member in the vertical direction.

4. The printing apparatus according to claim 2, wherein the apparatus body includes a sensor configured to detect whether the portion to be fixed is at a position where the portion to be fixed is fixed to the fixing portion.

5. The printing apparatus according to claim 1, wherein the apparatus body includes a contact portion with which the shaft member is brought into contact when the shaft member is attached to the support portion as the roll body holder unit approaches the apparatus body along the moving direction.

6. The printing apparatus according to claim 5, wherein the contact portion is formed with a guide structure configured to guide the shaft member to the support portion when the shaft member is attached to the support portion.

7. The printing apparatus according to claim 1, wherein the roll body holder unit includes a first contact portion and a second contact portion as the contact portion, and the shaft member, the first contact portion, the holding member, and the second contact portion are disposed in this order from a leading side in a direction that the roll body holder unit approaches the apparatus body along the moving direction.

* * * * *